US009526671B2

(12) United States Patent
Weck et al.

(10) Patent No.: US 9,526,671 B2
(45) Date of Patent: Dec. 27, 2016

(54) HAND HELD EXERCISE AND FITNESS DEVICE

(71) Applicant: BOSU Fitness, LLC, Wilmington, DE (US)

(72) Inventors: David S. Weck, San Diego, CA (US); Chasen S. Booher, Lakeside, CA (US); Roy R. Haas, Jr., San Diego, CA (US); Detlev F. Smith, Fairlawn, OH (US)

(73) Assignee: BOSU Fitness, LLC, San Diego, CA (US)

( * ) Notice: Subject to any disclaimer, the term of this patent is extended or adjusted under 35 U.S.C. 154(b) by 60 days.

(21) Appl. No.: 14/451,212

(22) Filed: Aug. 4, 2014

(65) Prior Publication Data

US 2015/0045192 A1 Feb. 12, 2015

Related U.S. Application Data

(60) Provisional application No. 61/863,221, filed on Aug. 7, 2013.

(51) Int. Cl.
*A63B 15/00* (2006.01)
*A61H 23/00* (2006.01)
(Continued)

(52) U.S. Cl.
CPC ..... *A61H 23/006* (2013.01); *A61H 23/06* (2013.01); *A63B 15/00* (2013.01); *A63B 21/0004* (2013.01); *A63B 21/0602* (2013.01); *A63B 21/0603* (2013.01); *A63B 21/072* (2013.01); *A63B 23/03541* (2013.01); *A63B 23/1209* (2013.01);
(Continued)

(58) Field of Classification Search
CPC ... A63B 15/00; A63B 15/005; A63B 21/0004; A63B 21/00061; A63B 21/00065; A63B 21/00185; A63B 21/0088; A63B 21/0602; A63B 21/0603; A63B 21/0604; A63B 21/0607; A63B 21/0608; A63B 21/068; A63B 21/072; A63B 21/0728; A63B 21/075; A63B 21/08; A63B 21/4023; A63B 21/4033; A63B 21/4035; A63B 21/4039; A63B 21/4043; A63B 23/03541; A63B 23/1209; A63B 23/1245; A63B 23/1281; A63B 23/14; A63B 2225/62; A63B 69/0002; A63B 69/0015; A63B 2069/0008; G01D 13/00; G01D 13/06; G01D 13/08
See application file for complete search history.

(56) References Cited

U.S. PATENT DOCUMENTS 1,399,071 A * 12/1921 Nowak ..... A63B 15/00 473/118
1,676,689 A * 7/1928 Dwyer ..... A63B 15/00 482/1
(Continued)

*Primary Examiner* — Oren Ginsberg
*Assistant Examiner* — Gary D Urbiel Goldner
(74) *Attorney, Agent, or Firm* — Richard D. Clarke

(57) ABSTRACT

The present invention is directed to Hand Held Exercise and Fitness Devices that deals with exercise, fitness and therapeutic massage that may be held in the hand and used for a wide range of wrist, forearm and shoulder manipulation, massage and fitness exercises. The preferred embodiment will be in the shape of an Indian club with a light weight handle and a soft flexible polymer head that can have a variety of materials in the inner cavity. The second embodiment will have the head in the shape of a sledge hammer with a long handle and constructed in a similar fashion as the preferred embodiment.

9 Claims, 7 Drawing Sheets

(51) Int. Cl.

| | |
|---|---|
| ***A61H 23/06*** | (2006.01) |
| ***A63B 21/00*** | (2006.01) |
| ***A63B 21/06*** | (2006.01) |
| ***A63B 21/072*** | (2006.01) |
| ***A63B 23/035*** | (2006.01) |
| ***A63B 23/12*** | (2006.01) |
| ***A63B 23/14*** | (2006.01) |

(52) U.S. Cl.
CPC ..... *A63B 23/1281* (2013.01); *A63B 23/14* (2013.01); *A61H 2205/062* (2013.01); *A63B 2225/62* (2013.01); *Y10T 29/49* (2015.01)

(56) References Cited

U.S. PATENT DOCUMENTS 2,143,337 A * 1/1939 Walton ..... A63B 15/00 482/109
2,223,574 A * 12/1940 Paves ..... A63B 15/00 482/108
2,225,151 A * 12/1940 Borba ..... A63B 15/00 340/321
2,935,321 A * 5/1960 Lhotka ..... A63B 15/00 273/317
3,516,673 A * 6/1970 Estes ..... A63B 21/0602 473/256
4,279,416 A * 7/1981 Finnigan, III ..... A63B 15/00 482/109
4,466,610 A * 8/1984 Israel ..... A63B 21/0023 482/91
4,693,469 A * 9/1987 Cedar ..... A63B 21/0608 482/110
4,696,468 A * 9/1987 Dube ..... A63B 15/00 473/118
4,787,623 A * 11/1988 Cedar ..... A63B 21/0608 482/110
5,044,626 A * 9/1991 Parker, Jr. ..... A61H 23/06 482/132
5,163,879 A * 11/1992 Black ..... A63B 15/00 431/255
5,180,163 A * 1/1993 Lanctot ..... A63B 60/10 473/520
5,827,142 A * 10/1998 Rappaport ..... A63B 59/50 473/567
5,873,783 A * 2/1999 McBain ..... F41B 15/025 135/75
6,210,302 B1 * 4/2001 Globus ..... A63B 15/00 482/106
6,228,002 B1 * 5/2001 Dantolan ..... A63B 15/00 482/109
7,037,243 B1 * 5/2006 Clancy ..... A63B 5/20 482/81
7,179,210 B2 * 2/2007 Soukeras ..... A63B 15/00 473/118
2005/0176561 A1 * 8/2005 Soukeras ..... A63B 15/00 482/109
2012/0149539 A1 * 6/2012 Quader ..... A63B 21/08 482/109
2014/0213422 A1 * 7/2014 Marcus ..... A63B 21/075 482/108

* cited by examiner

HAND HELD EXERCISE AND FITNESS DEVICE

FIELD OF THE INVENTION

This application deals with exercise, fitness and therapeutic massage devices that may be held in one hand or both hands and used for a wide range of wrist, forearm and shoulder manipulation, massage and total body fitness exercises.

BACKGROUND OF THE INVENTION

Club-like exercise devices have been used for exercise, training and rehabilitation dating back for hundreds of years, if not longer. One country of origin for these club-like exercise devices was India. British colonialists brought these training tools back from India to England and they came to be called "Indian Clubs." Indian Clubs became very popular in the late 1800's and into the early 1900's in England and then the United States. Indian Clubs were often made of wood and came in a wide variety of shapes and sizes. They were used by military soldiers for exercise and training, as well as by the general population for exercise. Modern club-like devices are generally made of wood, hard plastic composites or metal. Today Indian Clubs are making a resurgence but their popularity is limited in part because of the unforgiving hard materials used to construct them, and the associated risks of injury. Because Indian Clubs are constructed of a hard material they are dangerous, their application to total body exercise routines is limited for most people.

Juggling clubs resemble Indian Clubs but are usually lighter. The lighter construction of juggling clubs enables users to throw and catch them more easily whereas Indian Clubs are generally heavier and are not thrown, but rather swung about the body. Some juggling clubs are designed more specifically for training and incorporate a soft padded surface to prevent injury when a juggler misses a catch and the club hits his/her (hereafter referred to as his for convenience) body. While these training juggling clubs are similar to the present invention in that they incorporate soft padding on the clubs, their design is distinctly different from the present invention so that they can facilitate juggling as opposed to swinging them for exercise. Juggling clubs are designed with a balanced weight distribution that enables them to turn or rotate about a central axis for even and fluid rotations through the air to facilitate juggling. The present apparatus and method taught in the present invention have an uneven weight distribution between the club handles which are light and the club heads which are heavier making them unsuitable for throwing and catching but rather optimizes them for swinging exercises. The weight distribution between the handle and head of the present invention helps encourage and teaches a user to articulate the wrists and shoulders through a greater range of motion than when manipulating a more evenly weighted club.

Similar devices having extended handles such as sledgehammers are being used for exercise, primarily in the form of hitting truck tires in a gym. This exercise develops the coordination between the hands where one hand starts at the upper distal end adjacent to the head and slides down to the lower end of the handle during the swinging process, then connecting to a rigid object. Hammers and mallets with rubberized hammer heads are used as tools to hammer objects without denting or defacing them such as wooden furniture. Because many of these devices are constructed of hard materials with a rigid handle and metal hammer head, they are dangerous if not used with extreme caution. These hammers and mallets with rubberized heads are not suitable for many total body exercise routines because the rubberized hammer heads are still hard enough to cause injury if one happens to inadvertently strike his body. The act of hitting a rigged object with a limited cushioning effect provided by the present invention has additional benefits in some exercise routines.

The present Hand Held Exercise and Fitness Devices disclosed within this application and method taught enable a wider population of people with many fitness levels enjoy the benefits of exercise routines with less risk of injury and far wider application to total body exercise.

Numerous innovations for various hand held exercise and devices have been provided in the prior art that are described as follows. Even though these innovations may be suitable for the specific individual purposes to which they address, they differ from the present design as hereinafter contrasted. The following is a summary of those prior art patents most relevant to this application at hand, as well as a brief description outlining the difference between the features of the Hand Held Exercise Device and the prior art.

U.S. Pat. No. 7,179,210 of John E. Soukeras describes an exercise club, which may be held comfortably in one hand. Two of these clubs may be used, one in each hand, to execute a series of planned movements, which result in a full body workout. The weight of the clubs may be easily adjusted, to alter the intensity of the workout as desired. Virtually any person can use the clubs to improve their strength, health and fitness. This club can be made preferably of enforced polypropylene for rapid and quick volume production through injection molding.

This patent describes an exercise club with a head that is adjustable in position along the length of the handle but does not have the head with the unique capabilities of a club with a variety of soft polymer flexible heads that can be filled with varying quantities of a variety of granular substances including but not limited to ball bearings (commonly referred to as bb's), sand, gravel and variable density urethane foams or the additional inflatable head that will be capable of accommodating different air pressures.

U.S. Pat. No. 4,279,416 of Oliver D. Finnigan describes a juggling club which is composed of a sturdy hollow one-piece molded plastic body formed with a bulged end for receiving a tapered resilient knob, and also formed with a notched end for receiving a resilient tip. The body is formed of, for example, polyethylene, and it is inexpensive in its construction since it does not include a dowel pin, or the like, extending through the club for supporting the knob and tip at the opposite ends of the body.

This patent describes a juggling club which is composed of a sturdy hollow one-piece molded plastic body with a centralized weight distribution and does not incorporate the light weight handle along with not having the ability of a soft polymer flexible head.

U.S. Pat. No. 4,466,610 of Terry P. Israel describes a light weight exerciser or club adapted to assist the user to perform stretching, isometric, isotonic, and isokinetic exercises and to combine them with various aerobic exercises of walking or jogging. The exercise club has the shape of an elongate cylindrical shaft terminated in coaxially mounted end knobs serving as hand grips and has a length corresponding to the width of the chest of the user. The end knobs are dimensioned to be gripped by the hand with the palm resting against their outer ends with the fingers curving around the edges of the knob. The knobs are rounded in peripheral dimension and continuous to an inner wall which continues smoothly to and joins with the shaft so that the finger tips can lie along and grip the inwardly facing walls of the knob. Means are provided for forming various hand, finger, and thumb gripping surfaces. When the exerciser is constructed of wood such means can comprise grooves formed in the parts by scoring together with scallops formed in the rounded peripheral portions of the end knobs.

This patent describes a light weight exerciser or club adapted to assist the user to perform stretching, isometric, isotonic, and isokinetic exercises with hand knobs at both ends of a tubular member. It does not resemble the conventional Indian Club and does not indicate a club with a variety of soft polymer flexible heads that can be partially filled with a varying quantities of a variety of granular substances such as bb's, sand, gravel and low density urethane foam or the additional inflatable head that will be capable to different air pressures.

U.S. Pat. No. 4,696,468 of Brian J. Dube describes a juggling club that is formed of a hollow, unitary molded plastic body having a bulged portion, a relatively heavy knob and handle portion, and a center of gravity located at between 55 and 59 percent of the length of the longitudinal axis toward the bulged end of the club. The thickness of the body wall of the club is substantially greater at the handle and knob portions than at the bulged portion.

This patent describes another juggling club which is composed of a unitary molded plastic body having a bulged portion, a relatively heavy knob and handle portion with a centralized weight distribution and does not incorporate the light weight handle along with not having the ability of a number of soft polymer flexible heads.

There are no devices in the prior art that exists that would address the needs and create the specific advantages and benefits attendant with the Apparatus and Method for total body exercise routines using a sledgehammer-like device. The present design is a new, useful and non-obvious combination of method steps and component elements, with the use of a minimum number of functioning parts, at a reasonable cost to manufacture, and by employing readily available materials.

None of these previous efforts, however, provides the benefits attendant with the Hand Held Exercise and Fitness Devices disclosed within this application. The present designs achieve their intended purposes, objects and advantages over the prior art devices through a new, useful and non-obvious combination of method steps and component elements at a reasonable cost to manufacture, and by employing readily available materials.

In this respect, before explaining at least one embodiment of the Hand Held Exercise and Fitness Devices as a method for more effective exercise in detail, it is to be understood that the design is not limited in its application to the details of construction and to the arrangement, of the components set forth in the following description or illustrated in the drawings. The Hand Held Exercise and Fitness Devices used as a method for total body exercise are capable of other embodiments and of being practiced and carried out in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application.

SUMMARY OF THE INVENTION

The principal advantage of the preferred embodiment of the Hand Held Exercise Device is having an exercise club with a light weight handle and spherical head.

An advantage is the Hand Held Exercise Device in the configuration of a club will have a head made from a soft polymer flexible very durable material.

Another advantage of the Hand Held Exercise Device in the configuration of a club would be being able to use two of the devices, one in each hand.

Another advantage of the Hand Held Exercise Device in the configuration of a club is having a soft polymer flexible head that can be partially filled with a variety of granular substances such as bb's, sand or gravel that will shift position to the front of the head on impact.

Another advantage of the Hand Held Exercise Device is that it is safer when swinging around the body.

Another advantage of the Hand Held Exercise Device is that it is suitable for percussive exercises where a user intentionally taps his body with the Hand Held Exercise Device.

Another advantage of the Hand Held Exercise Device in the configuration of a club is having soft polymer flexible head that can be filled with a liquid.

Another advantage of the Hand Held Exercise Device in the configuration of a club is having soft polymer flexible head that can be filled with compressed air to produce different degrees of firmness.

Another advantage of the Hand Held Exercise Device in the configuration of a club is having a soft polymer flexible head that can be filled with a urethane foam material.

Another advantage of the Hand Held Exercise Device in the configuration of a club is that it can be used to exercise the wrist by holding and rotating the wrist, the forearm by raising and lowering at the elbow, and shoulder by rotating the full arm.

Another advantage of the Hand Held Exercise Device in the configuration of a club is that it can be used to massage body parts where the granular material inside the head produces a soft but firm impact conforming to the part of the body impacted.

An alternate embodiment of the Hand Held Exercise Device will have an extended handle and a head resembling a sledgehammer made from a soft polymer flexible very durable material.

Another advantage of the Hand Held Exercise Device resembling a sledgehammer is that the head may be filled with a soft urethane foam material.

Another advantage of the Hand Held Exercise Device resembling a sledgehammer is that it may be swung like a conventional sledgehammer without the possibility of damaging things.

Another advantage of the Hand Held Exercise Device resembling a sledgehammer is that it can be used to train individuals how to properly and safely swing a sledgehammer.

Another advantage of the Hand Held Exercise Device resembling a sledgehammer is that the head may be partially filled with a variety of granular substances including but not limited to granular metal, steel shot, bb's, sand or gravel.

Another advantage of the Hand Held Exercise Device resembling a sledgehammer is that the head may be partially filled with compressed air.

Another advantage of the Hand Held Exercise Device resembling a sledgehammer is that it is safer when swinging around the body.

Another advantage of the Hand Held Exercise Device resembling a sledgehammer is that it provides ideal rebound reaction when hitting hard surfaces to stimulate the muscles involved in decelerating the rebounding hammer.

Another advantage of the Hand Held Exercise Device resembling a sledgehammer is that the rebound "bounce" it creates is easier on joints and more effectively exercises the muscles, ligaments and tendons.

The preferred embodiment of the Hand Held Exercise Device would be in the configuration of a club with a lightweight ridged injection molded two part handle having restraining elements holding the spherical head made from a soft polymer flexible very durable material. The handle will be held together by the means of conventional screw type fasteners. A lanyard may be attached through an orifice in the lower distal end of the handle. The spherical head will have a groove around the mounting section with indentions on two opposing sides that engage with two restraining elements within the handle. The rib around the circumference of the inner surface lip of the two part handle engage within a groove in the spherical head, additionally restricting the movement within the device. Another style of head will have a thread on the insert section to engage within a threaded orifice in a one piece handle to be locked in place by the means of a single dowel pin. At this time it must be made clear that the spherical shape to the head of the device may have a wide variety of geometric shapes and sizes and still remain within the scope of this application.

The spherical head made from a soft flexible very durable polymer material may incorporate a tubular orifice in the mounting end to insert a variety of different materials such as granular elements or liquid to be sealed with a compressive plug or a urethane foam material that can be inserted within the internal cavity. Additionally self-skinning foam can be molded to form the club head. The amount and weight of the material within the head section can greatly affect the unique operations of the device. The spherical head may also be sealed with a needle valve orifice in the flat portion for a pressurized inflation.

An alternate embodiment of the Hand Held Exercise Device will have an extended fiber glass handle and a head made from a soft polymer flexible and very durable polymer material in a variety of shapes, with the preferred being of a sledgehammer. One design will have a weighted object, preferably steel, in the center of the head attached to the handle. The head would be filled with urethane foam or either using self-skinning foam molded for the outside covering.

A second design would additionally be made from a soft polymer flexible very durable polymer material with a mounting cavity on the upper and lower surfaces. A lower steel retainer will be permanently affixed to a light weight fiberglass handle. An upper steel retainer attached to the handle will have screw type fasteners extending through the head engaging in the lower steel retainer. The size of the steel retainers can vary depending on the desired weight of the device head. The head may incorporate an orifice in the upper mounting cavity to insert a variety of elements effecting the weight and balance. The head may also be sealed with a needle valve orifice for a pressurized inflation. Additionally the head may have a sealed inner cavity that has been filled with low density urethane foam.

In this respect, before explaining at least one embodiment of the preferred embodiment and alternate embodiment of the Hand Held Exercise Device application in detail, it is to be understood that the design is not limited in its application to the details of construction and to the arrangement of the components set forth in the following description or illustrated in the drawings. The Hand Held Exercise Device is capable of other embodiments and of being practiced and carried out in various ways. In addition, it is to be understood that the phraseology and terminology employed herein are for the purpose of description and should not be regarded as limiting.

BRIEF DESCRIPTION OF THE DRAWINGS

The accompanying drawings, which are incorporated in and form a part of this specification, illustrate embodiments of the Hand Held Exercise and Fitness Device and together with the description, serve to explain the principles of this application.

For a fuller understanding of the nature and advantages of the Hand Held Exercise and Fitness Device, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figure 1:
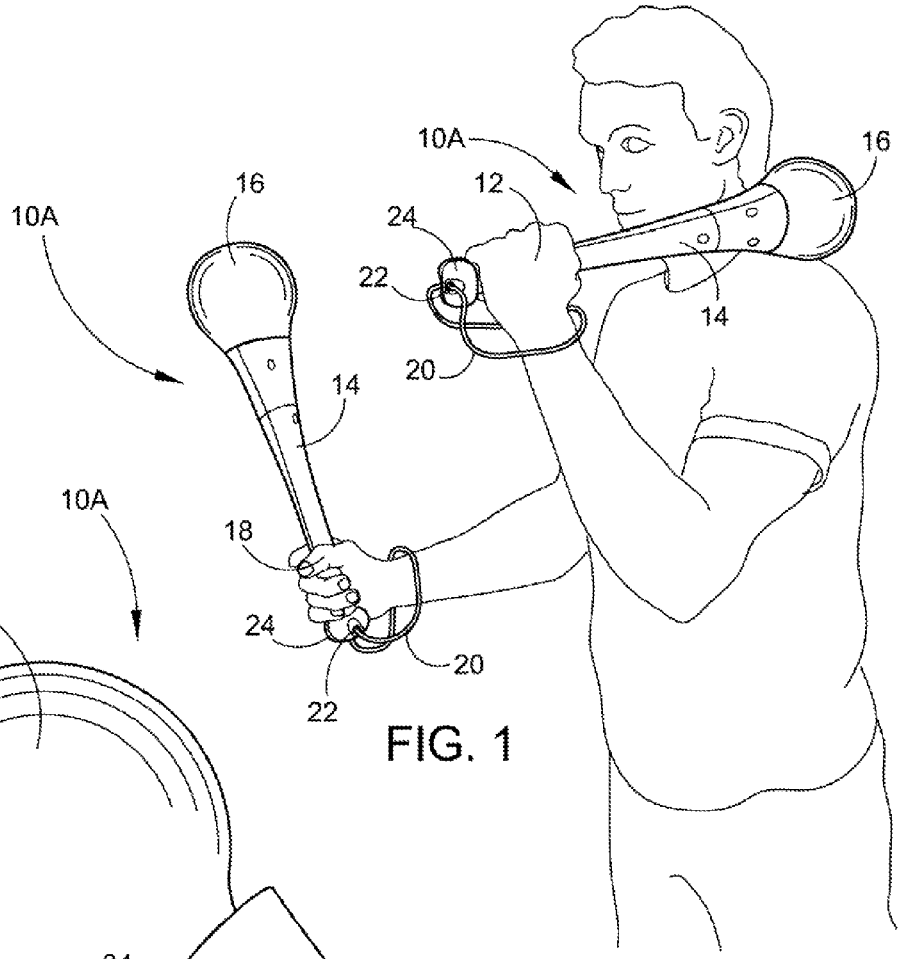
FIG. 1 depicts a perspective view of a person holding two of the preferred embodiments of the Hand Held Exercise Device.

Referring now to the drawings, wherein similar parts of the preferred embodiment of the Hand Held Exercise Device 10A and 10B (wherein the detailed description of JOB in is shown beginning with FIG. 12) are identified by like reference numerals, there is seen in FIG. 1 a perspective view of a person holding two of the preferred embodiments of the Hand Held Exercise Device 10A with one in his left hand 12 holding the handle 14 massaging his left shoulder with the spherical head 16 and the other in his right hand 18 holding the handle 14 in an upright position. Lanyards 20 are illustrated going around the wrists and attached through an orifice 22 in the grip end 24 of the handle 14.

Figure 2:
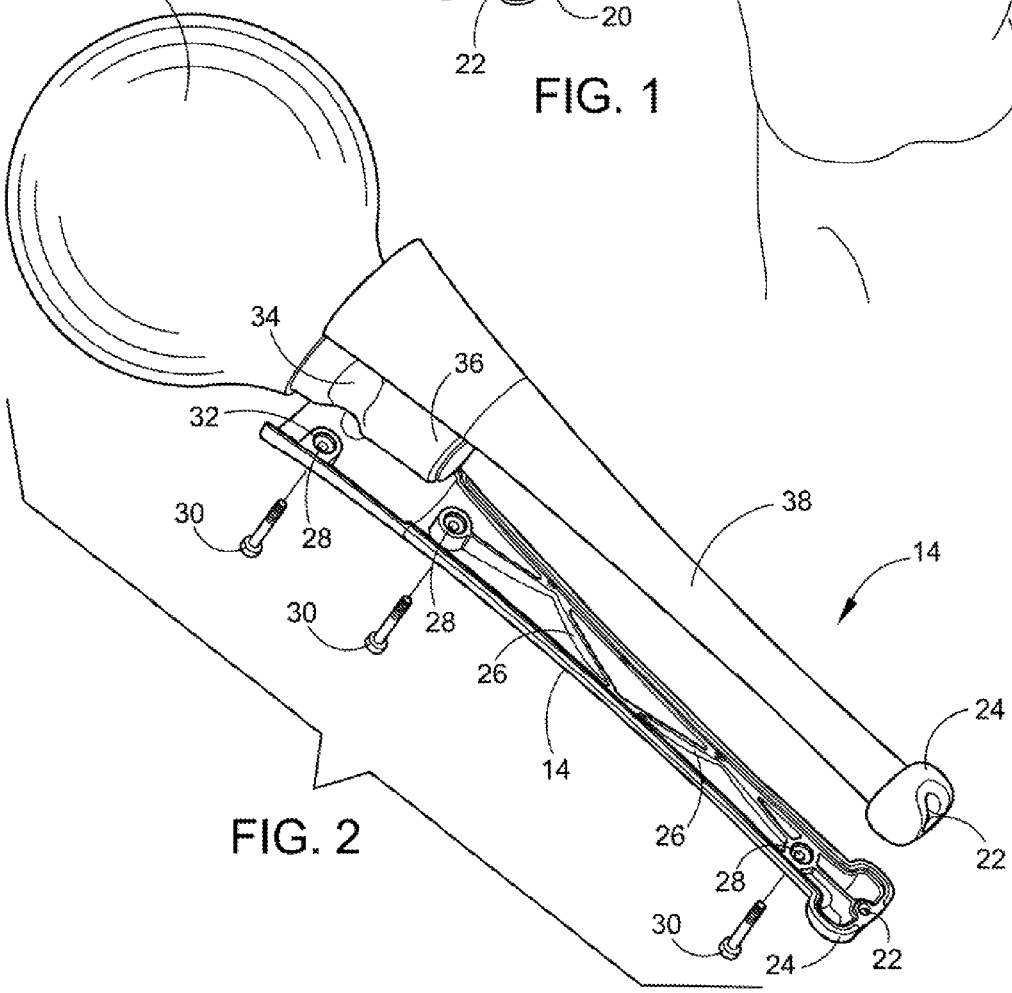
FIG. 2 depicts a perspective view of an exploded view of the preferred embodiments of the Hand Held Exercise Device.

FIG. 2 depicts a perspective view of an exploded view of the preferred embodiments of the Hand Held Exercise Device 10A illustrating the reinforcing ribs 26 in the handle 14 with the mounting screw orifices 28 where the mounting screws 30 secure the two halves of the handle 14 together. Two additional mounting screw orifices 28 are located in the spherical head retainers 32 that locate within the two depressions 34 on either side of the head insertion section 36 of the spherical head 16. The handle 14 may be constructed with an over-molded rubberized grip surface, and that rubberized grip surface may be comprised of thermoplastic rubber (also known as TPR). Other rubberized sleeves and grips can alternatively be used in place of over-molded material.

Figure 3:
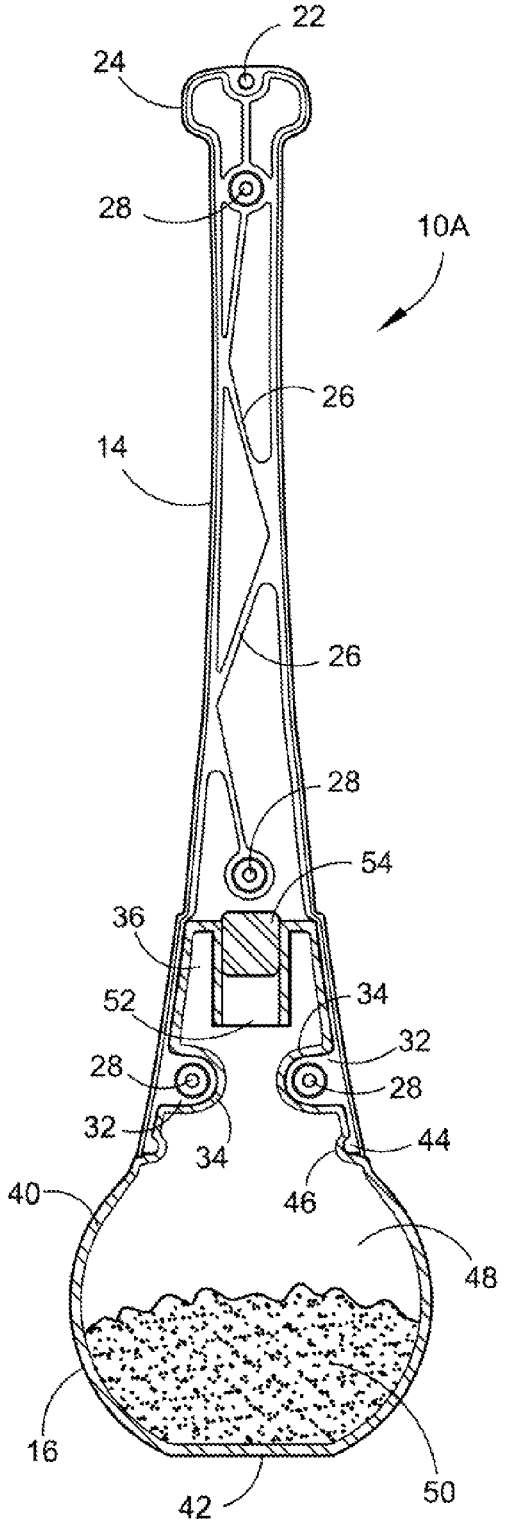
FIG. 3 depicts a cross section through the preferred embodiments of the Hand Held Exercise Device.

FIG. 3 depicts a cross section through the preferred embodiments of the Hand Held Exercise Device 10A illustrating the orifice 22 for the lanyard 20 in the grip end 24 of the handle 14. A polarity of reinforcing ribs 26 extend through the central portion 38 of the handle 14. Four mounting screw orifices 28 are the locations where the mounting screws 30 hold the two halves of the handle 14 together. The spherical head 16 consists of an outer shell 40 that can be manufactured by, but not limited to a rotational molding process with a flat surface 42 on the spherical end so that the device can stand upright and the head insertion section 36 at the other end. The insertion section 36 is held within the two halves of the handle 14 by the means of the two depressions 34 on the opposing sides being locked in place by the means of the two spherical head retainers 32 on both inside surfaces of the handle 14. Additionally a circumferential rib 44 at the distal end of the handle 14 locks into the circumferential groove 46 at the edge of the insertion section 36 of the spherical head 16. The central cavity 48 of the spherical head 16 is partially filled with a granular material 50. At the upper end of the head insertion section 36 is a tubular orifice 52 for the purpose of installing a variety of materials into the central cavity 48 and will be sealed with a plug 54. With regard to contemplated dimensions, the proportion of the club head diameter in relation to the widest portion of the handle at the attachment location may be in the ratio of 2:1, as shown here in FIG. 3. For example, if the club head diameter is approximately 6 inches, then the fluted upper portion of the handle at the attachment location would be approximately 3 inches.

Figure 4:
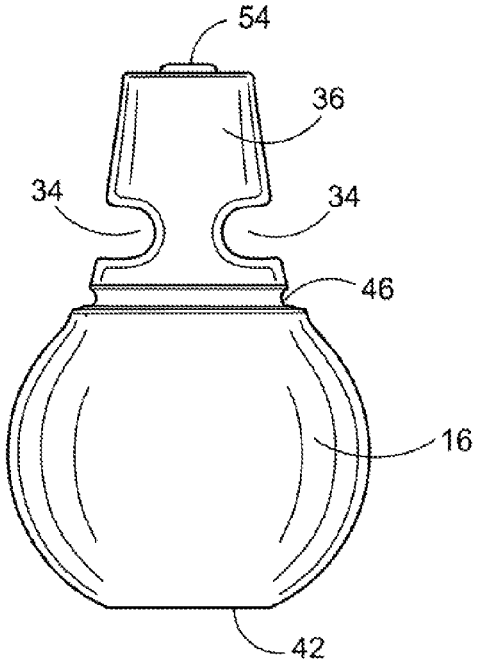
FIG. 4 depicts a front view of the spherical head of the preferred embodiments of the Hand Held Exercise Device.

FIG. 4 depicts a front view of the of the spherical head 16 of the preferred embodiments of the Hand Held Exercise Device 10A further illustrating the locations of the two depressions 34 on the opposing sides of the head insertion section 36.

Figure 5:
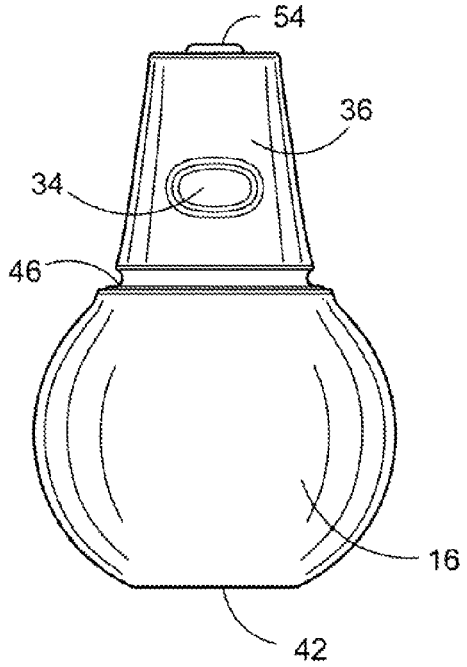
FIG. 5 depicts a side view of the spherical head of the preferred embodiments of the Hand Held Exercise Device.

FIG. 5 depicts a side view of the spherical head 16 of the preferred embodiments of the Hand Held Exercise Device 10A additionally illustrating the locations of the two depressions 34 on the opposing sides of the head insertion section 36.

Figure 6:
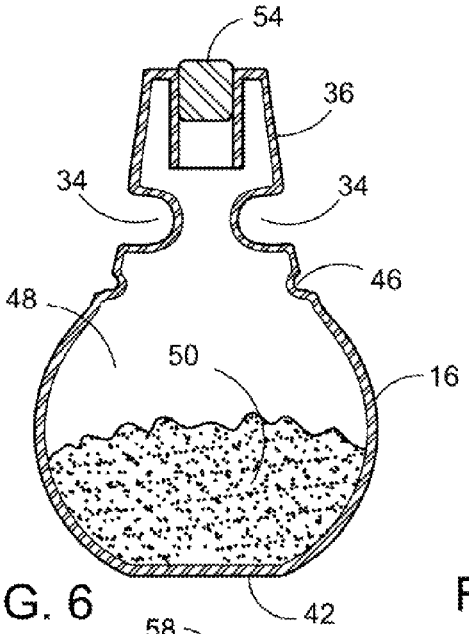
FIG. 6 depicts a cross section of the spherical head with a partial granular filling.

FIG. 6 depicts a cross section of the spherical head 16 with a partial granular material filling 50 within the central cavity 48.

Figure 7:
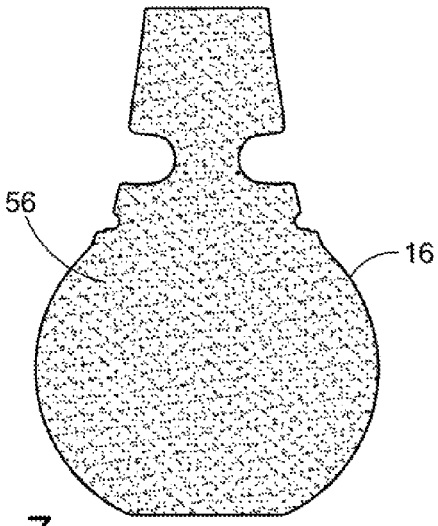
FIG. 7 depicts a cross section of the spherical head constructed of self-skinning urethane foam.

FIG. 7 depicts a cross section of the spherical head 16 constructed in one piece of self-skinning urethane foam 56.

Figure 8:
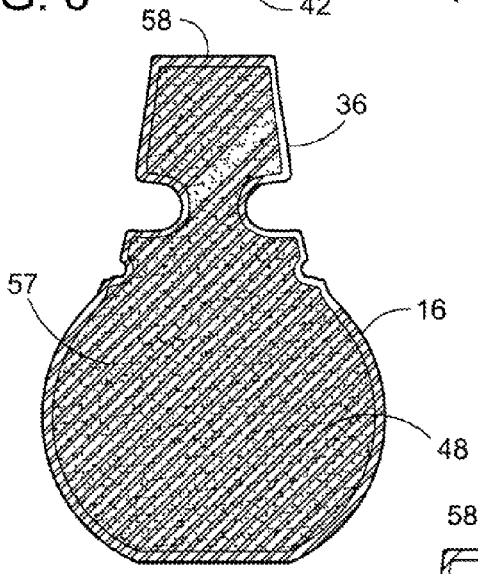
FIG. 8 depicts a cross section of the spherical head filled with urethane foam.

FIG. 8 depicts a cross section of the spherical head 16 manufactured by a rotational molding process with a flat surface 42 on the spherical end and the surface 58 sealed to be filled with urethane foam 57.

Figure 9:
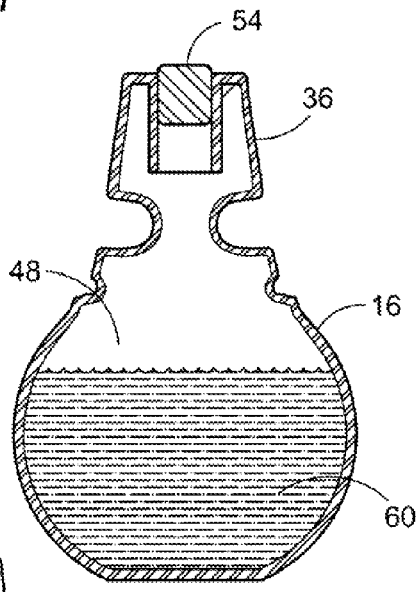
FIG. 9 depicts a cross section of the spherical head partially filled with a liquid.

FIG. 9 depicts a cross section of the spherical head 16 with the central cavity 48 partially filled with a liquid 60.

Figure 10:
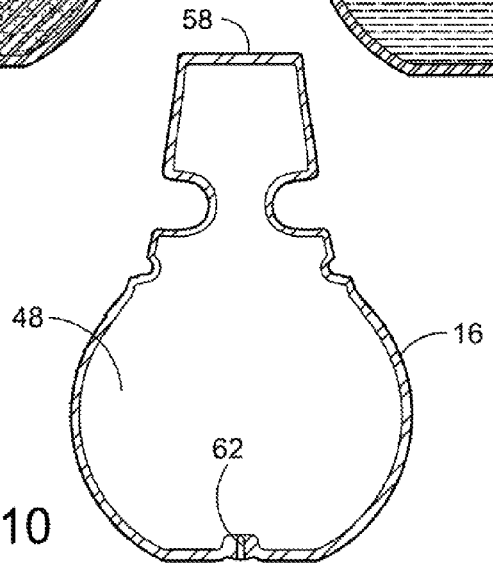
FIG. 10 depicts a cross section of the spherical head incorporating a needle valve opening.

FIG. 10 depicts a cross section of the spherical head 16 incorporating a needle valve opening 62 into the central cavity 48 for a pressurized inflation.

Figure 11:
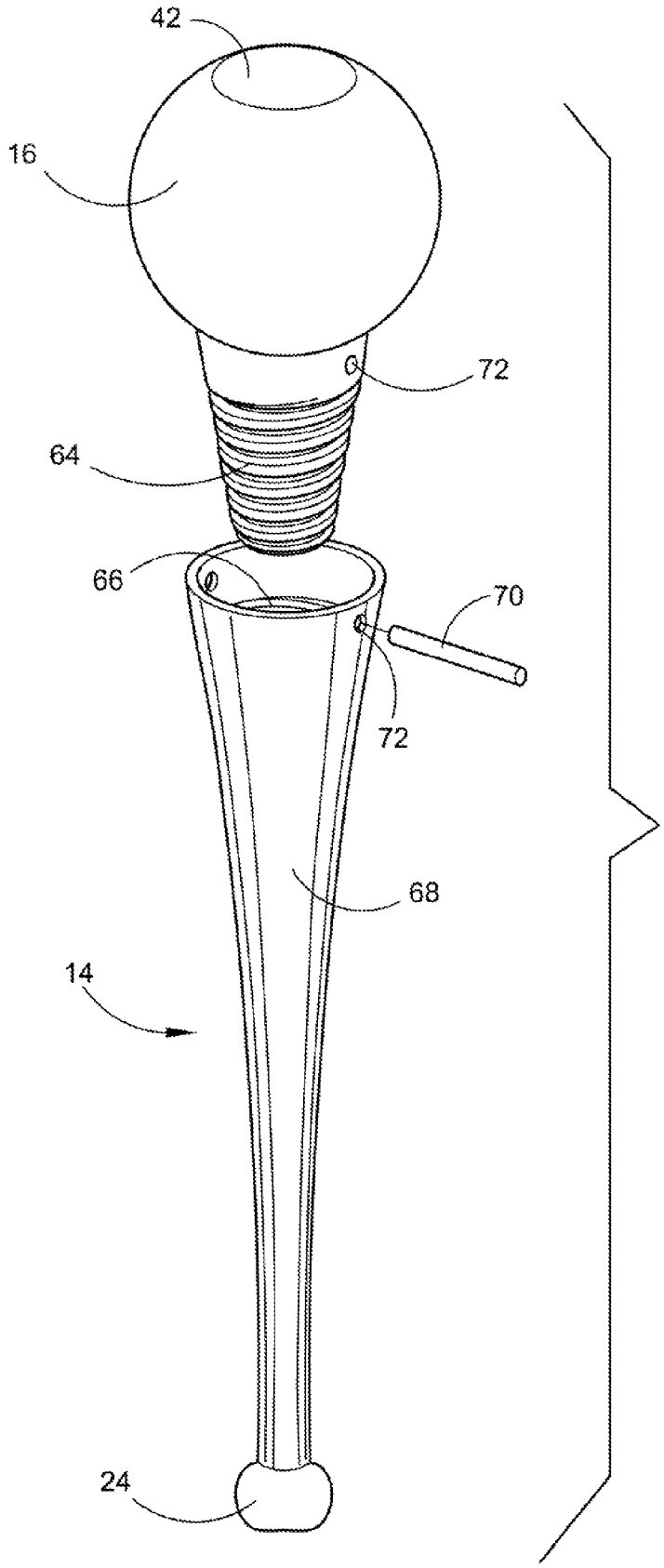
FIG. 11 depicts a perspective view of the style of spherical head having a thread on the insert section to engage within a threaded orifice in a one piece handle to be locked in place by the means of a single dowel pin.

FIG. 11 depicts a perspective view of the style of spherical head 16 having a thread on the insert section 64 to engage within a threaded orifice 66 in a one piece handle 68 to be locked in place by the means of a single dowel pin 70 going through orifice 72 in the handle 14.

Figure 12A:
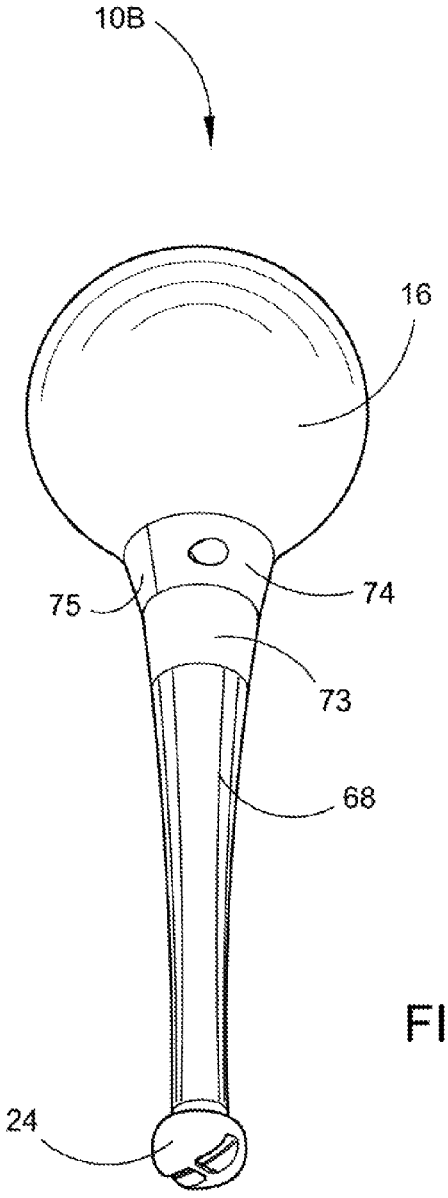
FIG. 12A depicts a perspective view of an alternate embodiment of the Hand Held Exercise Device illustrating a three piece handle in the preferred configuration of a spherical head.

FIG. 12A depicts a perspective view of an alternate embodiment of the Hand Held Exercise Device illustrating a three-piece handle in the preferred configuration of a spherical head. The three piece handle is comprised of a handle upper portion 73, a locking annulus side 1 74 and a locking annulus side 2 75. The locking annulus sides function to secure the spherical head to the handle portion as described in FIG. 12 B below.

Figure 12B:
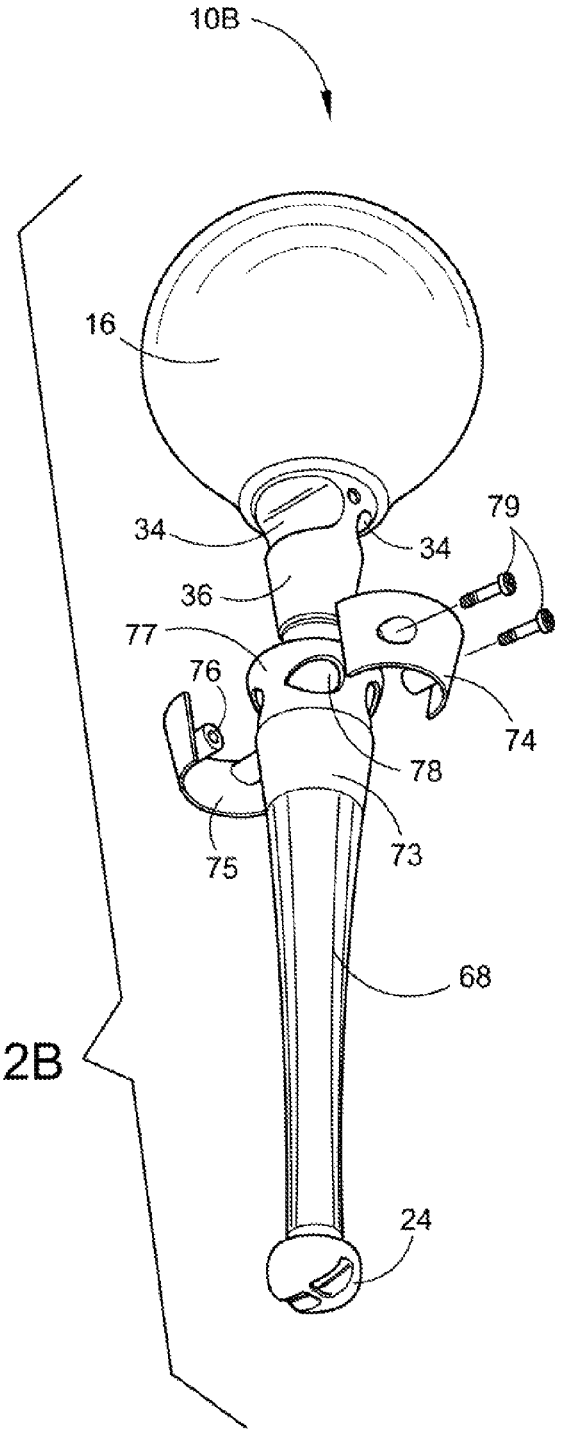
FIG. 12B depicts a perspective exploded view of the alternate embodiment of the Hand Held Exercise Device, shown in FIG. 12A, in the preferred configuration of a three piece handle and spherical head.

FIG. 12B depicts a perspective exploded view of the alternate embodiment of the Hand Held Exercise Device, shown in FIG. 12A, in the preferred configuration of a three piece handle and spherical head. The three piece handle is comprised of a handle upper portion 73, a locking annulus side 1 74 and a locking annulus side 2 75. Each of the locking annulus sides 1 and 2, 74 and 75, respectively, include a threaded locking channel 76. The interface 77 of the club handle with the locking annulus is constructed with openings 78 which accept both of the locking annulus side 1 74 and locking annulus side 2 75. These are then secured using fasteners, in this embodiment, screws 79 which are accepted by the threaded locking channels 76 of the locking annulus sides. In this way, the three-piece handle with locking annulus sides functions well to secure the handle to the spherical head.

Figure 13A:
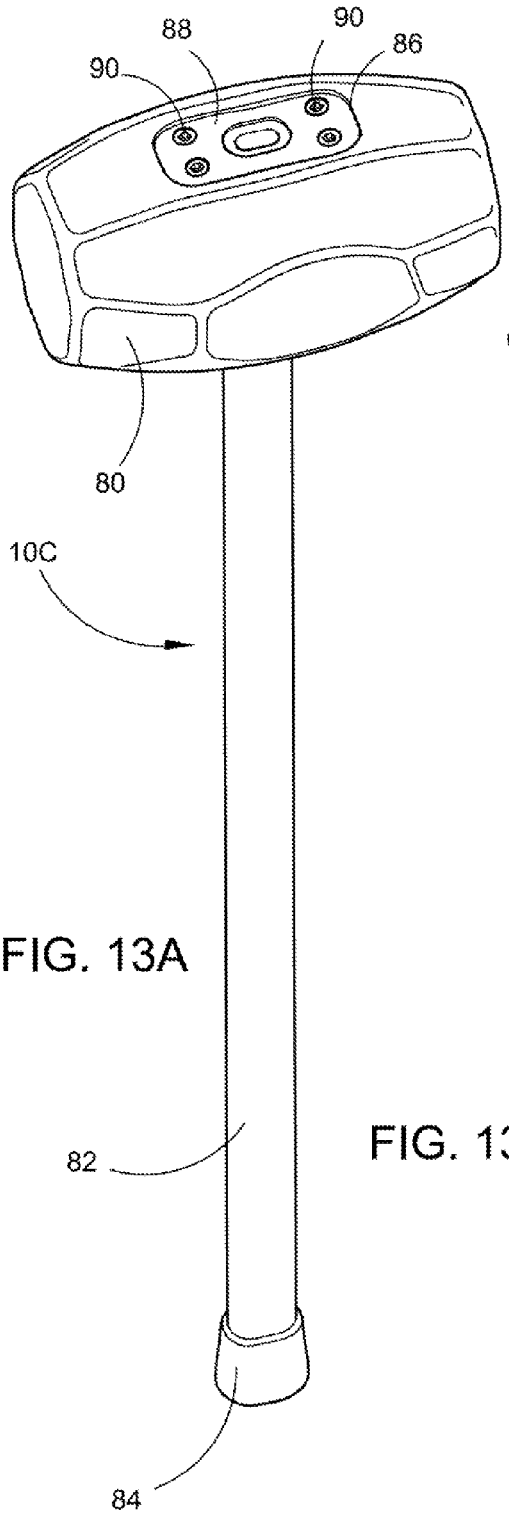
FIG. 13A depicts a perspective view of another alternate embodiment of the Hand Held Exercise Device in the preferred configuration of a sledge hammer.

FIG. 13A depicts a perspective view of the alternate embodiment of the Hand Held Exercise Device 10B in the preferred configuration of the head 80 made from a soft polymer flexible very durable polymer material in the same manner as the spherical club head 16 and in a variety of shapes with the preferred being of a sledgehammer appearance with a long extended fiber glass handle 82 having a grip stopper section 84. The upper surface of the head 80 is cavity 86 with an upper metal handle retainer 88 with mounting screws 90.

Figure 13B:
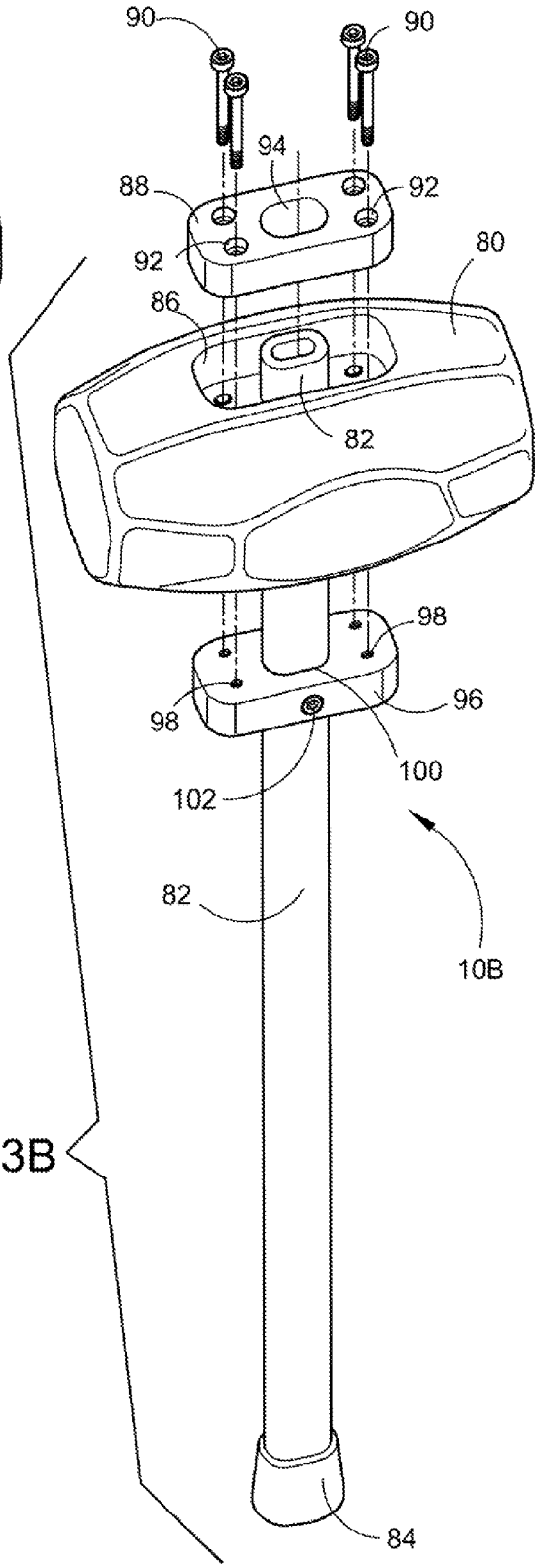
FIG. 13B depicts a perspective exploded view of the alternate embodiment of the Hand Held Exercise Device, shown in FIG. 13A, in the preferred configuration of a sledge hammer.

FIG. 13B depicts a perspective exploded view of the alternate embodiment of the Hand Held Exercise Device 10B in the preferred configuration of a sledge hammer illustrating the upper metal handle retainer 88 and the mounting screws 90 pulled away from the cavity 86. The upper metal handle mount 88 has four counter bored orifices 92 for the mounting screws 90 and a central elongated orifice 94 for the fiber glass handle 82. Below the head 80 is illustrated the lower metal handle mount 96 with four threaded orifices 98 for mounting along with a central elongated orifice 100 handle locking screw 102 on the side. The upper metal handle retainer 88 and the lower metal handle retainer 96 can vary in size and shape depending upon the desired weight of the device.

Figure 14:
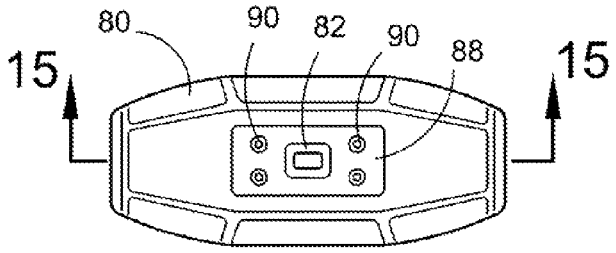
FIG. 14 depicts a top view of the head of the sledge hammer configuration of the Hand Held Exercise Device with the steel retainers.

FIG. 14 depicts a top view of the head 80 of the sledge hammer configuration of the Hand Held Exercise Device 10B illustrating the location of the upper metal handle retainer 88 along with the mounting screws 90 and the direction that the lower sections were taken.

Figure 15:
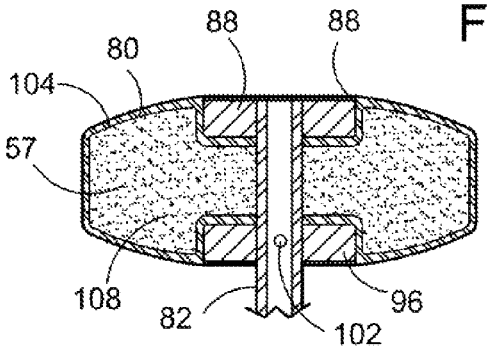
FIG. 15 depicts a cross section of the head of the sledge hammer configuration of the Hand Held Exercise Device with the steel retainers.

FIG. 15 depicts a cross section of the head 80 of the sledge hammer configuration of the Hand Held Exercise Device 10B with the upper metal handle retainer 88 and the lower metal handle retainer 96 in place within the outer shell 104. The inner cavity 106 is filled with urethane foam 57.

Figure 16:
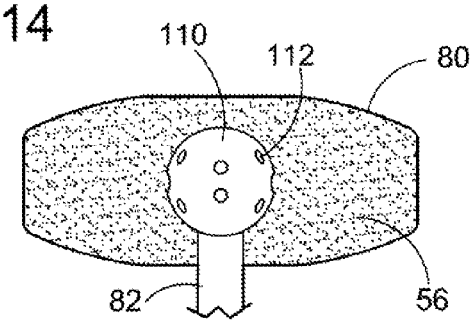
FIG. 16 depicts a cross section of the head of the sledge hammer configuration of the Hand Held Exercise Device having a weighted insert attached to the handle with the molded self-skinning urethane outer covering.

FIG. 16 depicts a cross section of the head 80 of the sledge hammer configuration of the Hand Held Exercise Device 10B having a weighted insert 110 attached to the fiber glass handle 82 with the molded self-skinning urethane foam 56 outer covering. The weighted insert 110 can be a variety of shapes but in this case has been shown as a sphere with a plurality of orifices 112 to help stabilize it within the foam structure.

Figure 17:
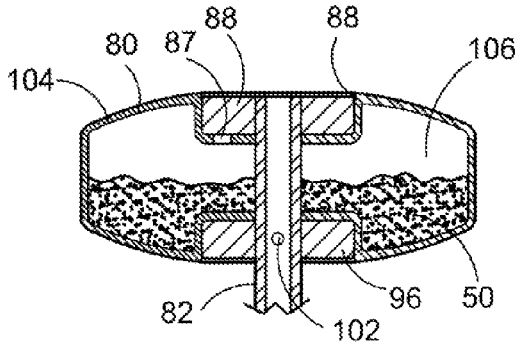
FIG. 17 depicts a cross section of the head of the sledge hammer configuration of the Hand Held Exercise Device with a partial granular filling.

FIG. 17 depicts a cross section of the head 80 of the sledge hammer configuration of the Hand Held Exercise Device 10B with a partial granular filling 50 in the inner cavity 106. Within the cavity 86 and located below the upper metal handle mount 88 there is shown an orifice 87 for adding fill to the head 80.

Figure 18:
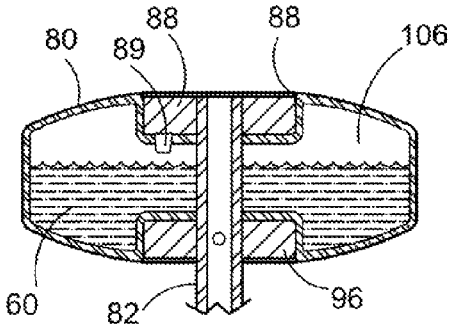
FIG. 18 depicts a cross section of the head of the sledge hammer configuration of the Hand Held Exercise Device with a partial liquid filling.

FIG. 18 depicts a cross section of the head 80 of the sledge hammer configuration of the Hand Held Exercise Device 10B with a partial liquid filling 60 in the inner cavity 106. Within cavity 86 and located below the upper metal handle mount 88 there is shown an orifice 89 for adding fill to the head 80.

Figure 19:
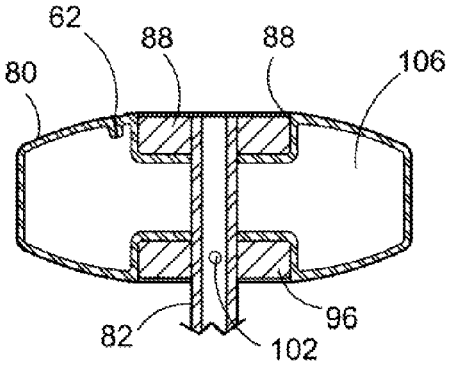
FIG. 19 depicts a cross section of the head of the sledge hammer configuration of the Hand Held Exercise Device with a needle valve orifice for a pressurized inflation.

FIG. 19 depicts a cross section of the head 80 of the sledge hammer configuration of the Hand Held Exercise Device 10B with a needle valve orifice 62 for a pressurized inflation in the inner cavity 106.

Figure 20:
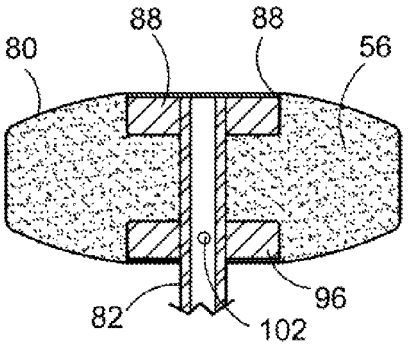
FIG. 20 depicts a cross section of the head of the sledge hammer configuration of the Hand Held Exercise Device that is made with the steel retainers on the handle using a self-skinning urethane foam for the outer covering.

FIG. 20 depicts a cross section of the head 80 of the sledge hammer configuration of the Hand Held Exercise Device 10B that is made with the metal handle retainers 88 and 96 on the fiber glass handle 82 using the molded self-skinning urethane foam 56 for the outer covering.

The Hand Held Exercise and Fitness Devices 10A and 10B shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing Hand Held Exercise and Fitness Devices 10A and 10B in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly and readily the nature and essence of the technical disclosure of the application. The abstract is neither intended to define the invention of the application, which is measured by the claims, nor is it intended to be limiting as to the scope of the invention in any way.

We claim:

1. A hand held exercise and fitness device comprising: a) a handle section having a gripping portion and a head attachment portion; b) a head section having a handle attachment portion, wherein said head section includes a variably fillable hollow core portion; wherein said head section variably fillable hollow core portion includes a single cavity therein for accepting an added weight; wherein said added weight is placed within said single cavity and is configured to be capable of shifting with movement of said head section; wherein said head section includes a sealable plug to contain and secure said added weight located within said single cavity within said variably fillable hollow core portion; and wherein said head section is lock-ably attachable to said handle section by utilizing a threaded connection and a securing dowel pin, whereby said head attachment portion includes locking threads integral to said handle section and said handle attachment portion includes mating locking threads capable of accepting said locking threads of said head attachment portion, and whereby said head section is threaded onto said handle section then secured by placement of said dowel pin.

2. The hand held exercise and fitness device according to claim 1, wherein said head section is constructed of an outer flexible pliable material.

3. The hand held exercise and fitness device according to claim 2, wherein said outer flexible pliable material includes PVC vinyl material.

4. The hand held exercise and fitness device according to claim 1, wherein said head section variably fillable hollow core portion is capable of allowing said added weight positioned within said single cavity within the head section to freely move throughout the entire variably fillable hollow core portion and thereby shift with movement of said head section.

5. The hand held exercise and fitness device according to claim 1, wherein said head section includes a tubular orifice and said sealable plug is a removable sealable plug fitted within said tubular orifice such that it can be readily removed and said added weight readily adjusted by being removed or added.

6. The hand held exercise and fitness device according to claim 1, wherein said head section variably fillable hollow core portion is partially filled with granular material as said added weight which is configured to be capable of shifting with movement, wherein said granular material includes granular metal or sand.

7. The hand held exercise and fitness device according to claim 1, wherein said gripping portion includes an over molded rubberized grip surface constructed of rubberized material.

8. The hand held exercise and fitness device according to claim 1, wherein said head section variably finable hollow core portion is filled with liquid material as said added weight, which is configured to be capable of shifting with movement, wherein said liquid material includes water.

9. The hand held exercise and fitness device according to claim 1, wherein said head section includes a needle valve.

* * * * *